US011633318B2

(12) United States Patent
Ohta et al.

(10) Patent No.: US 11,633,318 B2
(45) Date of Patent: Apr. 25, 2023

(54) ASSIST DEVICE

(71) Applicant: JTEKT CORPORATION, Osaka (JP)

(72) Inventors: Hiromichi Ohta, Kariya (JP); Kazuyoshi Ohtsubo, Chiryu (JP); Yoshitaka Yoshimi, Kashiba (JP); Tomoki Arai, Kitakatsuragi-gun (JP)

(73) Assignee: JTEKT CORPORATION, Osaka (JP)

( * ) Notice: Subject to any disclaimer, the term of this patent is extended or adjusted under 35 U.S.C. 154(b) by 196 days.

(21) Appl. No.: 17/326,874

(22) Filed: May 21, 2021

(65) Prior Publication Data

US 2021/0361516 A1 Nov. 25, 2021

(30) Foreign Application Priority Data

May 25, 2020 (JP) ..... JP2020-090537

(51) Int. Cl.
*A61H 1/02* (2006.01)

(52) U.S. Cl.
CPC ..... *A61H 1/0274* (2013.01); *A61H 2201/1215* (2013.01); *A61H 2201/164* (2013.01); *A61H 2201/165* (2013.01); *A61H 2201/1614* (2013.01); *A61H 2201/1619* (2013.01); *A61H 2201/1635* (2013.01); *A61H 2201/1671* (2013.01); *A61H 2230/625* (2013.01)

(58) Field of Classification Search
CPC ..... A61H 1/0274; A61H 1/00; A61H 2201/1215; A61H 2201/1614; A61H 2201/1619; A61H 2201/1635; A61H 2201/164; A61H 2201/165; A61H 2201/1671; A61H 2230/625; B25J 9/0006; B25J 9/1602
See application file for complete search history.

(56) References Cited

U.S. PATENT DOCUMENTS 9,333,644 B2 * 5/2016 Angold ..... B25J 9/0006
2005/0130815 A1 * 6/2005 Abdoli-Eramaki ..... A61H 3/00 482/121

(Continued)

FOREIGN PATENT DOCUMENTS

JP 2008067762 A * 3/2008
JP 2015039414 A * 3/2015 ..... B25J 9/0006

(Continued)

*Primary Examiner* — Rachel T Sippel
*Assistant Examiner* — Kelsey E Baller
(74) *Attorney, Agent, or Firm* — Oblon, McClelland, Maier & Neustadt, L.L.P.

(57) ABSTRACT

An assist device includes a first body-worn unit that is worn on at least shoulders or a chest of a user; a second body-worn unit that is worn on each of right and left legs or a waist of the user; a belt body provided to extend along a back side of the user, from the first body-worn unit to the second body-worn unit; an actuator provided in the first body-worn unit or the second body-worn unit and allows a part of the belt body to be reeled and unreeled; a battery configured to supply electricity to the actuator; and a controller configured to control the actuator. When a remaining charge level of the battery has decreased to a predetermined set value, the controller executes a vibrating motion process of causing the actuator to perform a vibrating motion of intermittently repeating reeling of a minute amount of the belt body.

3 Claims, 10 Drawing Sheets

(56) References Cited

U.S. PATENT DOCUMENTS

| | | | | |
|---|---|---|---|---|
| 2016/0184166 | A1* | 6/2016 | Takenaka | A61H 3/00 623/57 |
| 2018/0272525 | A1 | 9/2018 | Kumeno et al. | |
| 2018/0325764 | A1* | 11/2018 | Yagi | B25J 11/009 |
| 2019/0029910 | A1* | 1/2019 | Kikutani | B25J 11/00 |
| 2020/0289357 | A1 | 9/2020 | Sato et al. | |
| 2021/0353494 | A1 | 11/2021 | Yoshimi et al. | |

FOREIGN PATENT DOCUMENTS

| | | | |
|---|---|---|---|
| JP | 2018-199205 | A | 12/2018 |
| JP | 2020-146760 | A | 9/2020 |
| JP | 2021-171877 | A | 11/2021 |
| JP | 2021-181131 | A | 11/2021 |

* cited by examiner (FORWARD LEANING POSTURE)

(UPRIGHT STANDING POSTURE)

ASSIST DEVICE

CROSS-REFERENCE TO RELATED APPLICATION

This application claims priority to Japanese Patent Application No. 2020-090537 filed on May 25, 2020, incorporated herein by reference in its entirety.

BACKGROUND

1. Technical Field

The disclosure relates to an assist device.

2. Description of Related Art

Various assist devices that are worn on the bodies of users (persons) to assist the users in tasks have been proposed. When lifting a heavy object, for example, a user of an assist device can perform the task with a smaller force (with less burden). Such an assist device is disclosed, for example, in Japanese Patent Application Publication No. 2018-199205 (JP 2018-199205 A).

SUMMARY

The assist device disclosed in JP 2018-199205 A has a frame made of metal etc. that is worn by a user. An output of an actuator installed in this frame is transmitted to the upper body and the lower body of the user through a link mechanism. This assists the user, for example, in an action of lifting a heavy object.

Actions in which users need assistance include, for example, actions of assisting (helping) a person such as a sick person or an elderly person in performing activities of daily living, in addition to physically taxing actions such as lifting a heavy object. When a user performs a physically taxing task, a high-output assist device as disclosed in JP 2018-199205 A is effective.

However, when a user assists a person such as a sick person or an elderly person, the performance of a high-output assist device is in some cases superfluous. In addition, a high-output assist device uses many rigid members, including a link mechanism and a frame made of metal etc., and has a massive structure to produce a high output. Thus, the assist device is heavy, and the rigid members restrict the movement of the user.

As a solution, the inventors of the disclosure have already proposed an assist device that is lightweight and comfortable to wear (e.g., Japanese Patent Application No. 2019-043462). This assist device includes a first body-worn unit that is worn on the shoulders of a user, a second body-worn unit that is worn on the right and left legs of the user, a belt body that is provided to extend along the back side of the user, from the first body-worn unit to the second body-worn unit, and an actuator. The actuator is provided in the first body-worn unit and allows a part of the belt body to be reeled and unreeled.

When the actuator reels a part of the belt body, a tensile force is exerted on the belt body. This tensile force acts on the user as an assist force. Thus, the burden on the user is reduced, for example, when the user assists a person as described above.

This assist device includes the actuator, a controller for the actuator, and a battery that supplies electricity to parts including the actuator. The actuator, the controller, and the battery are provided inside a control box that is provided on the back side of the upper body of the user.

The state of the assist device, particularly the remaining charge level of the battery, needs to be notified to the user wearing the assist device. One possible way to do this is to provide an indicator that notifies the remaining charge level of the battery, in the control box housing the battery. However, since the control box is provided on the back side of the user, the user would have difficulty checking the indicator. Another possibility is to provide the indicator independently of the control box, at a position where it is visible to the user, which, however, would increase the cost and therefore is not preferable. Thus, a method for appropriately notifying the user of the remaining charge level of the battery at a low cost is desired.

An assist device according to one aspect of the disclosure includes a first body-worn unit that is worn on at least either shoulders or a chest of a user; a second body-worn unit that is worn on either each of right and left legs or a waist of the user; a belt body that is provided to extend along a back side of the user, from the first body-worn unit to the second body-worn unit; an actuator that is provided in either the first body-worn unit or the second body-worn unit and allows a part of the belt body to be reeled and unreeled; a battery configured to supply electricity to the actuator; and a controller configured to control the actuator. The controller is configured such that when a remaining charge level of the battery has decreased to a predetermined set value, the controller executes a vibrating motion process of causing the actuator to perform a vibrating motion of intermittently repeating reeling of a minute amount of the belt body.

When the remaining charge level of the battery has decreased to the predetermined set value, the assist device having the above configuration executes the vibrating motion process of causing the actuator to perform the vibrating motion of intermittently repeating reeling of a minute amount of the belt body. This vibrating motion can notify the user that the remaining charge level of the battery has decreased to the predetermined set value. Thus, it is possible to appropriately notify the user of the remaining charge level of the battery at a low cost without providing an indicator or the like.

In the assist device according to the above aspect, the vibrating motion may include a plurality of motion patterns different from each other in at least one of an amount of reeling of the belt body, a repetition period of reeling, and the number of times of repetition of reeling; the predetermined set value may include a plurality of predetermined set values different from each other; the motion patterns may be respectively linked to the predetermined set values; and the controller may be configured such that in the vibrating motion process, when the remaining charge level of the battery has decreased to one of the predetermined set values, the controller causes the actuator to perform the vibrating motion with one of the motion patterns, the one of the motion patterns being linked to the one of the predetermined set values.

In the assist device according to the above aspect, the controller may be configured to execute the vibrating motion process during a time period other than during normal operation in which the actuator is caused to reel and unreel the part of the belt body according to a posture of the user. In this case, the vibrating motion can be performed while the user remains in the same posture, and thus, the user can easily recognize the vibrating motion as compared with when the vibrating motion is performed while the user is changing his or her posture.

The assist device according to the above aspect of the disclosure can appropriately notify the user of the remaining charge level of the battery at a low cost.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Overall Configuration of Assist Device 10

Figure 1:
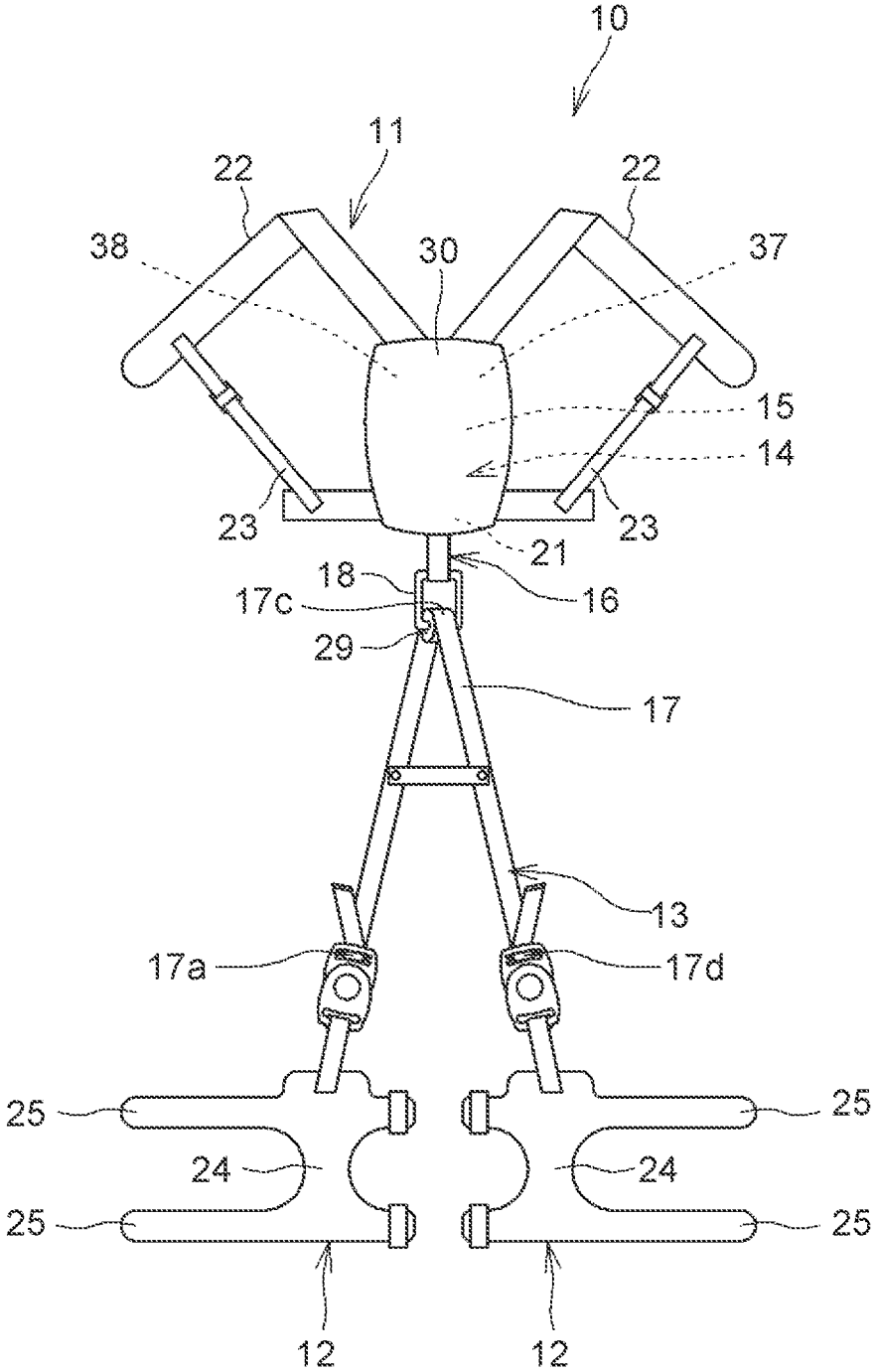
FIG. 1 is a back view showing one example of an assist device.
Figure 2:
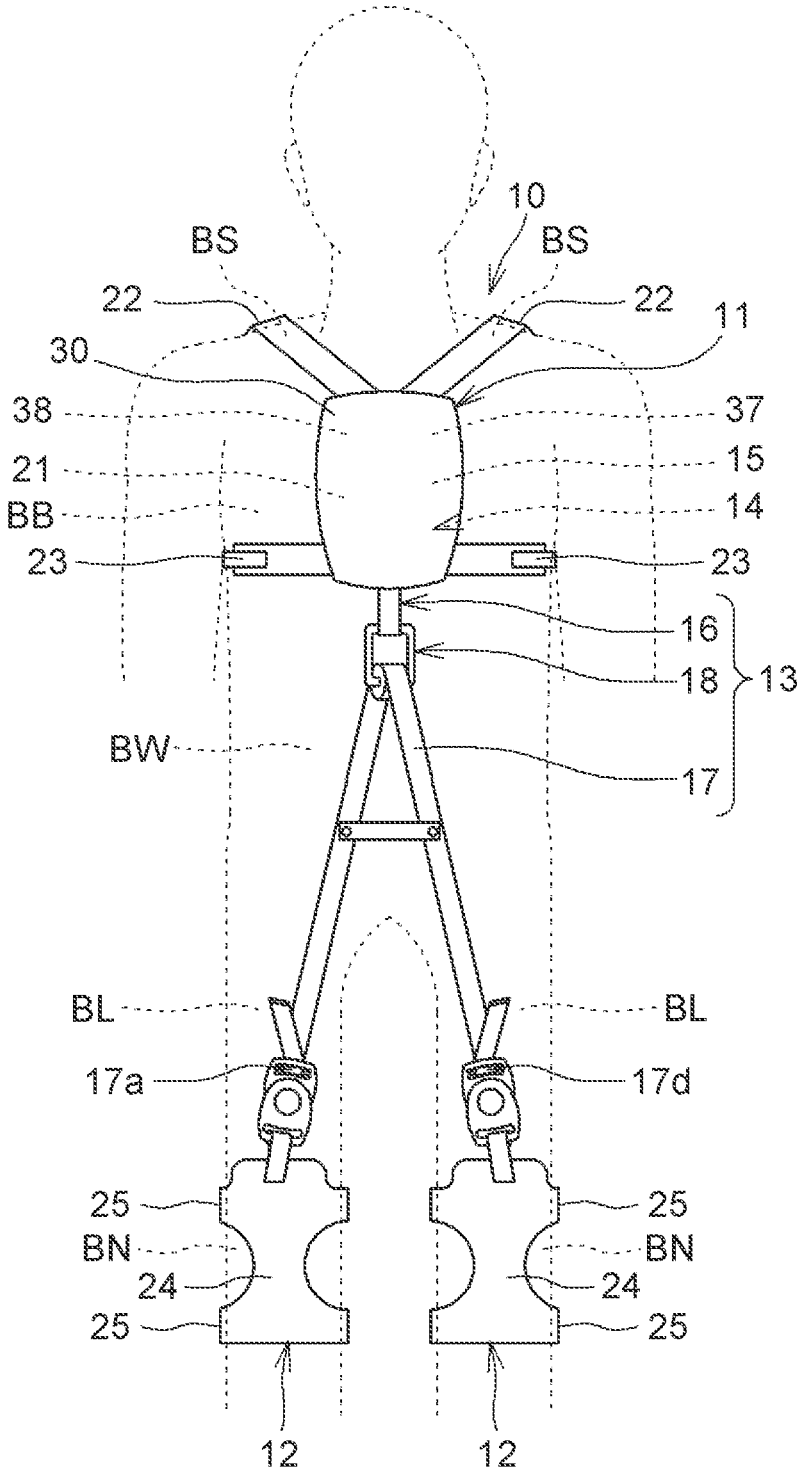
FIG. 2 is a back view of the assist device attached to the body of a user.
Figure 3:
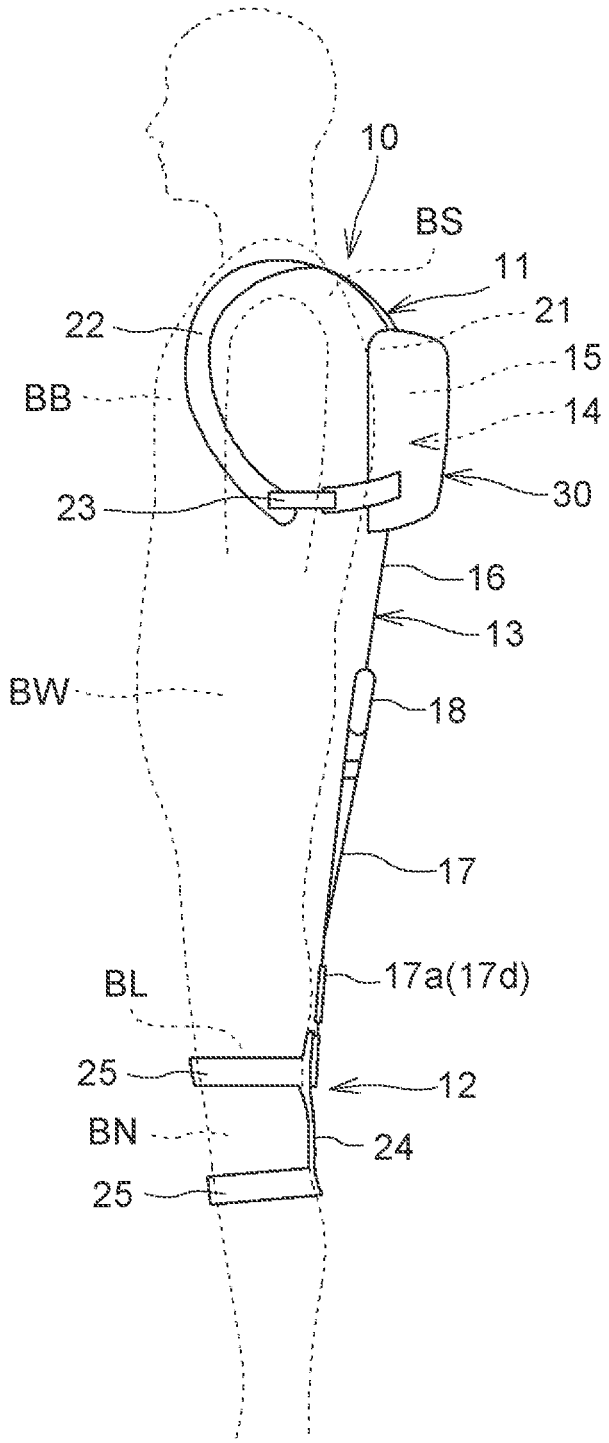
FIG. 3 is a side view of the assist device attached to the body of the user.
Figure 4:
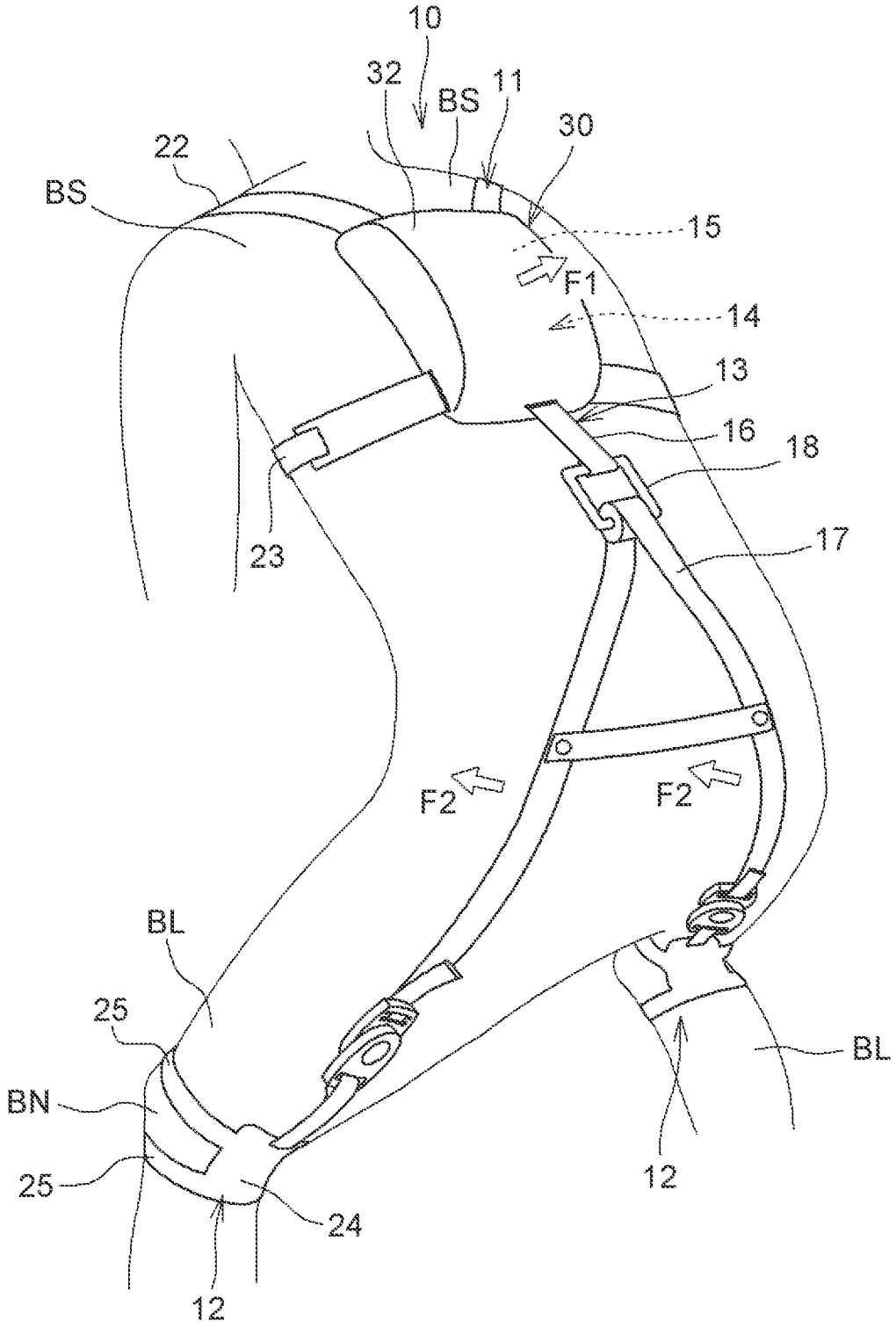
FIG. 4 is a view illustrating a state where the user wearing the assist device has assumed a forward leaning posture.

FIG. 1 is a back view showing one example of an assist device. FIG. 2 is a back view of the assist device attached to the body of a user. FIG. 3 is a side view of the assist device attached to the body of the user. FIG. 4 is a view illustrating a state where the user wearing the assist device has assumed a forward leaning posture (forward bending posture). An assist device 10 shown in FIG. 1 includes one first body-worn unit 11 that is worn on the right and left shoulders BS that are parts of the body of the user (person), and two second body-worn units 12 that are worn on the right and left legs BL that are other parts of the body of the user. The first body-worn unit 11 can be worn on at least either the shoulders BS or the chest BB of the user, and may have a form different from that shown in the drawings. In this disclosure, the second body-worn units 12 are worn on the knees BN in the legs BL. The second body-worn units 12 may also have a form different from that shown in the drawings.

In the assist device 10 of this disclosure, right and left sides are right and left sides of a user wearing the assist device 10 and in an upright standing posture. Front and back sides are front and back sides of the user, and upper and lower sides are upper and lower sides of the user. The upper side is the side of the head of the user and the lower side is the side of the feet of the user.

The assist device 10 includes a belt body 13, an actuator 14, a controller 15, a battery 37, and a sensor 38, in addition to the first body-worn unit 11 and the right and left second body-worn units 12.

The first body-worn unit 11 is worn on the shoulders BS of the user. One of the second body-worn units 12 is worn on the left knee BN of the user. The other second body-worn unit 12 is worn on the right knee BN of the user. The left second body-worn unit 12 and the right second body-worn unit 12 are symmetrical and have the same configuration. The first body-worn unit 11 and the two second body-worn units 12 are worn at two sites that are separated from each other and are respectively located on both sides of the waist BW that is a joint of the user. That is, the first body-worn unit 11 and the two second body-worn units 12 are worn on the shoulders BS and the legs BL.

The first body-worn unit 11 is made of flexible fabric or the like. The first body-worn unit 11 includes a back main part 21 that is worn on the back of the user, and shoulder belts 22 and underarm belts 23 that are connected to the back main part 21. The back main part 21 is carried on the back of the user with the use of the shoulder belts 22 and the underarm belts 23. Each underarm belt 23 connects the back main part 21 and the corresponding shoulder belt 22 to each other, and the length of each underarm belt 23 is adjustable. The lengths of the underarm belts 23 are adjusted so as to bring the back main part 21 into close contact with the back of the user. The first body-worn unit 11 is worn so as to be unable to move in front-rear, right-left, and up-down directions relatively to the shoulders BS. The first body-worn unit 11 may include hard members, for example, as parts that are laid over the shoulders BS.

The second body-worn units 12 are made of flexible fabric or the like. Each second body-worn unit 12 includes a knee main part 24 that is worn on the back side of the knee BN of the user, and knee belts 25 that are provided so as to extend from the knee main part 24. The knee belts 25 are wrapped around the knee BN at positions above and below the knee BN and fixed at their leading ends to the knee main part 24. The lengths of the knee belts 25 wrapped around the knee BN can be adjusted with the use of an engaging member, such as a belt and a buckle or a touch-and-close fastener (i.e., a hook-and-loop fastener). These lengths are adjusted so as to bring the knee main part 24 into close contact with the back side of the knee BN. The second body-worn unit 12 is worn so as to be unable to move in the front-rear, right-left, and up-down directions relatively to the knee BN.

The belt body 13 is provided to extend along the back side of the user so as to connect the first body-worn unit 11 and the second body-worn units 12 to each other. The belt body 13 includes a first belt 16 that is provided on the upper body side, a second belt 17 that is provided on the lower body side, and a coupling member 18 that couples the first belt 16 and the second belt 17 together. Each of the first belt 16 and the second belt 17 is elongated and flexible. The coupling member 18 is made of metal and formed by a rectangular annular body called a flat ring. The coupling member 18 may be other than a flat ring, and may be a fastener such as a buckle. When the coupling member 18 is a buckle, the first belt 16 and the second belt 17 are respectively attached to upper and lower loops (holes) of the buckle. When the coupling member 18 is a buckle, it is highly convenient in that the second belt 17 can be separated from the first belt 16, for example, when cleaning the second belt 17. The coupling member 18 formed by a flat ring, a buckle, or the like may be made of resin other than metal.

Each of the first belt 16 and the second belt 17 is a band-like member made of fabric or leather and can curve along the shape of the body. Alternatively, each of the first belt 16 and the second belt 17 may be a string-shaped belt (wire-shaped member). Each of the first belt 16 and the second belt 17 of this disclosure is a non-stretchable member, i.e., has a property of hardly stretching or not stretching in a longitudinal direction thereof.

Figure 5:
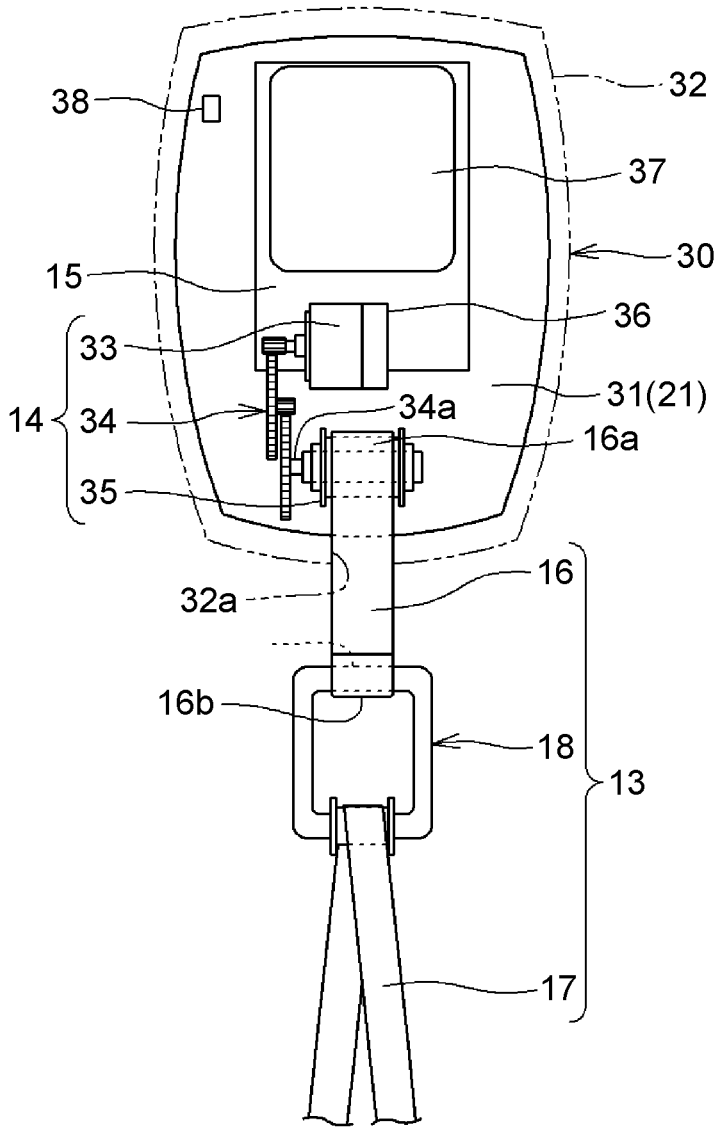
FIG. 5 is a view illustrating a control box and a belt body.

The assist device 10 of this disclosure includes a control box 30. The control box 30 is provided in the back main part 21 of the first body-worn unit 11. FIG. 5 is a view illustrating the control box 30 and the belt body 13. The control box 30 includes a plate-shaped base 31 and a cover 32 that covers the base 31. To illustrate the internal structure of the control box 30, the cover 32 is indicated by an imaginary line (alternate long and two short dashes line) in FIG. 5. The base 31 may constitute the back main part 21 of the first body-worn unit 11.

The actuator 14, the controller 15, the battery 37, the sensor 38, etc. are provided in a space formed between the base 31 and the cover 32. The cover 32 has an opening (cut portion) 32*a*, through which the first belt 16 is passed.

The actuator 14 is provided inside the control box 30. In other words, the actuator 14 is provided in the first body-worn unit 11. The actuator 14 allows a part of the belt body 13 to be reeled and unreeled. For this purpose, the actuator 14 includes a motor 33, a speed reducer part 34, and a driving pulley 35. The motor 33 is a brushless DC motor. The motor 33 can be rotated at a predetermined torque and a predetermined number of rotations based on a control command including a current command value that is output from the controller 15. The motor 33 is controlled so as to be able to rotate in normal and reverse directions based on the control command output from the controller 15. Thus, the motor 33 is subjected to current control performed by the controller 15.

Parameters relating to rotation of the motor 33, such as the rotation angle, the rotation speed, and the number of rotations, are detected by a rotation detector 36 that is mounted on the motor 33. The rotation detector 36 of this disclosure is a rotary encoder but may instead be a Hall sensor or a resolver. A detection result of the rotation detector 36 is input into the controller 15. With the controller 15 controlling the operation of the motor 33 based on the detection result, the assist device 10 can generate an appropriate assist force.

The speed reducer part 34 includes a plurality of gears, and reduces the number of rotations of the motor 33 and rotates an output shaft 34*a* of the speed reducer part 34. The driving pulley 35 is coupled to the output shaft 34*a*, and these parts rotate integrally. One end part 16*a* of the first belt 16 is attached to the driving pulley 35. When the motor 33 rotates in the normal direction and causes the driving pulley 35 to rotate in one direction, the first belt 16 is reeled onto the driving pulley 35. When the motor 33 rotates in the reverse direction and causes the driving pulley 35 to rotate in the other direction, the first belt 16 is unreeled from the driving pulley 35.

Thus, the actuator 14 includes the driving pulley 35 that can reel the belt body 13, and the motor 33 that causes the driving pulley 35 to perform an action of reeling the belt body 13. The first belt 16 is reeled and unreeled by the actuator 14.

The controller 15 is formed by a control unit including a microcomputer. The controller 15 has a function of controlling the operation of the actuator 14 (motor 33). As the sensor 38, a triaxial acceleration sensor is used. Signals of the sensor 38 are given to the controller 15. Based on the signals from the sensor 38, the controller 15 can estimate (infer) the posture of the user. The battery 37 supplies electricity to the controller 15, the motor 33, the rotation detector 36, and the sensor 38. The battery 37 is, for example, a secondary battery such as a lithium-ion battery. The sensor 38 may be provided outside the control box 30.

The belt body 13 includes the first belt 16, the second belt 17, and the coupling member 18 as described above. The one end part 16*a* of the first belt 16 is wound and fixed on the driving pulley 35. The other end part 16*b* of the first belt 16 is fixed on the coupling member 18. When the first belt 16 is reeled onto the driving pulley 35, the coupling member 18 is pulled up. When the coupling member 18 is forcibly pulled down, the first belt 16 is reeled out (pulled out) from the driving pulley 35. There is a correlation between the amount by which the first belt 16 is reeled in or reeled out (pulled out) by the driving pulley 35 and the amount of rotation of an output shaft of the motor 33. A parameter relating to rotation of the motor 33 involved in reeling in or reeling out of the belt body 13 is detected by the rotation detector 36.

Sensor 38 and Controller 15

In FIG. 5, the sensor 38 is formed by a triaxial acceleration sensor as mentioned above. The controller 15 can execute various computation processes. An action and a posture of the user can be detected by the controller 15 performing computation processes on signals from the sensor 38. The sensor 38 has a configuration for outputting a signal according to the posture of the user, and functions as a posture detector that detects the posture of the user. Based on an output from the sensor 38, the controller 15 can detect a state as to, for example, whether the posture of the upper body of the user is in a forward leaning posture or an upright standing posture, or can detect that the user has crouched.

There is a correlation between the amount by which the belt body 13 is reeled onto and unreeled from the driving pulley 35 by the motor 33 and the posture of the user. Therefore, the controller 15 can infer the posture of the user based on the rotation angle of the motor 33 detected by the rotation detector 36.

The controller 15 processes signals from one or both of the sensor 38 and the rotation detector 36. The controller 15 outputs a control command including a current command value to the actuator 14 (motor 33) according to the result of the process, i.e., the posture of the user. Based on the control command, the actuator 14 (motor 33) is operated to reel and unreel the belt body 13 as well as temporarily stop reeling or unreeling.

Here, a mode of the operation of the parts when the controller 15 controls the operation of the actuator 14 (motor 33) using signals from the rotation detector 36 will be described. In a state where the assist device 10 is worn by a user, the motor 33 is controlled by the controller 15 so as to operate (generate a torque) in a direction of reeling the belt body 13 with a smaller force than when generating an assist force and exert a small tensile force on the belt body 13. This prevents the belt body 13 from loosening.

When the user changes his or her posture, e.g., assumes a forward leaning posture from an upright standing posture, a tensile force due to the change in posture is exerted on the belt body 13. In this case, therefore, when the user starts to change his or her posture to a forward leaning posture, the motor 33 is forcibly rotated (the motor 33 idles) by the tensile force of the belt body 13 to reel out the belt body 13, without being powered by the actuator 14. Alternatively, when the user starts to change his or her posture to a forward leaning posture, the actuator 14 operates, i.e., drives the motor 33 to rotate and thereby unreel the belt body 13.

Conversely, when the user assumes an upright standing posture from a forward leaning posture, the belt body 13 tries to loosen due to the change in posture. In this case, therefore, when the user starts to change his or her posture to an upright standing posture, the actuator 14 operates, i.e., drives the motor 33 to rotate and thereby reel the belt body 13, in order to maintain the tensile force acting on the belt body 13.

As has been described, the belt body 13 is reeled or unreeled in response to a change in posture of the user. In this reeling or unreeling, the motor 33 is actively or passively rotated to a predetermined rotation angle. This rotation angle is detected by the rotation detector 36. Thus, the amount of operation of the actuator 14 (motor 33) when reeling or unreeling the belt body 13 in response to a change in posture of the user is detected by the rotation detector 36. Then, the controller 15 acquires the amount of operation of the actuator 14 (the rotation angle of the motor 33) when reeling or unreeling the belt body 13 in response to a change in posture of the user, and based on this amount of operation, obtains a posture parameter showing the posture of the user. Based on this posture parameter, the controller 15 can control the operation of the actuator 14 so as to provide the user with an assist force. In this way, the controller 15 controls the operation of the actuator 14 (motor 33) using signals from the rotation detector 36.

Figure 6:
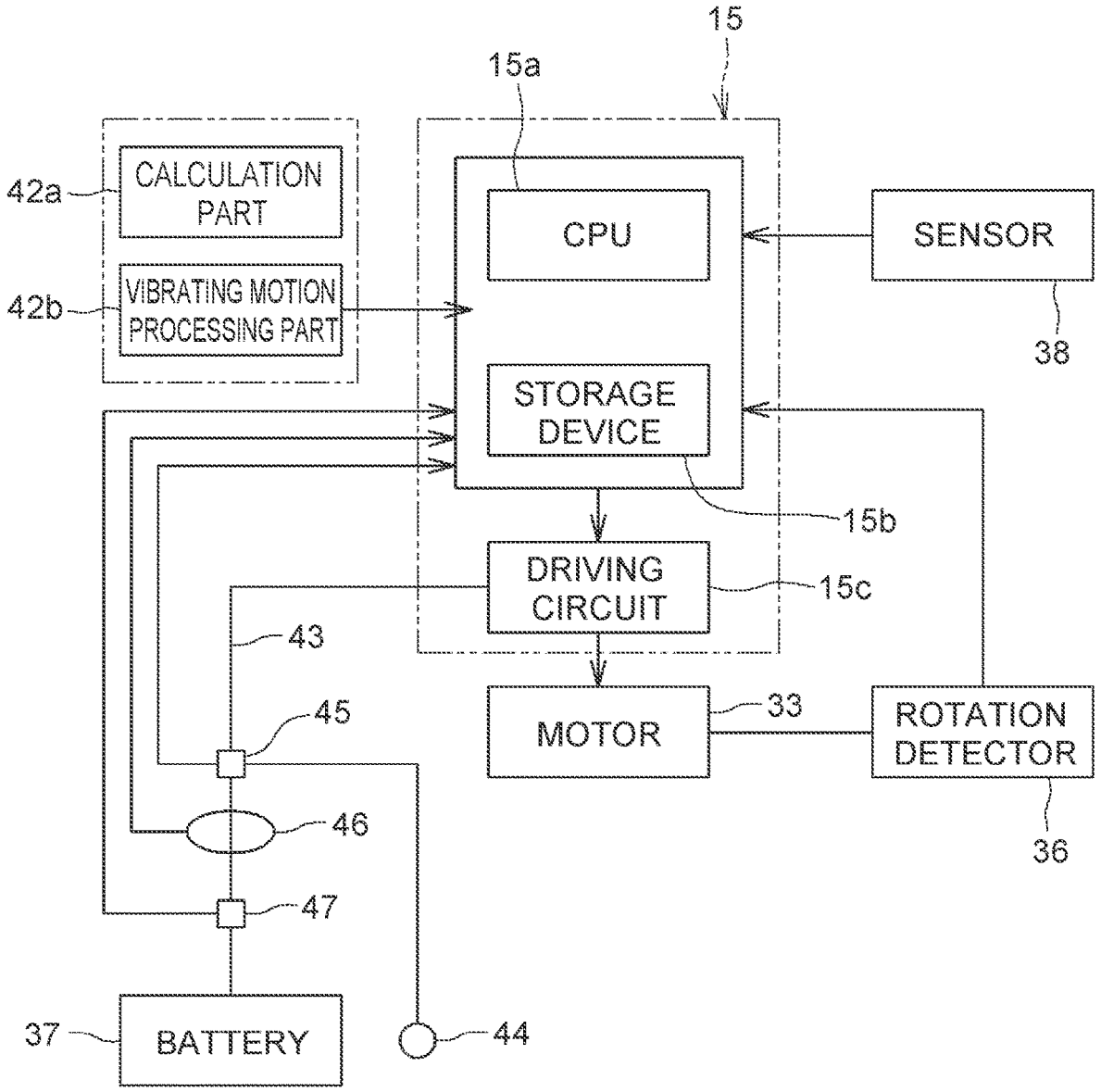
FIG. 6 is a block diagram showing a control configuration of the assist device.

FIG. 6 is a block diagram showing a control configuration of the assist device 10. The rotation detector 36 and the sensor 38 are connected to the controller 15. The controller 15 controls the parts shown in FIG. 6 and acquires outputs from the rotation detector 36 and the sensor 38.

The controller 15 is formed by a control unit including a microcomputer, and includes a central processing unit (CPU) 15*a* and a storage device (storage part) 15*b*, such as a memory. The CPU 15*a* executes various computation processes based on various programs, various parameters, etc. stored in the storage device 15*b*. The controller 15 of this disclosure includes a calculation part 42*a* and a vibrating motion processing part 42*b* as functional parts that are realized by a computation process executed by the CPU 15*a*. The controller 15 further includes a driving circuit (motor driver) 15*c* that controls the operation of the motor 33. The driving circuit 15*c* includes an inverter that drives the motor 33 by supplying the motor 33 with a current that is supplied from the battery 37, a circuit that controls this inverter, and so on. The motor 33 executes a predetermined action when these various functional parts and the driving circuit 15*c* cooperate with each other.

In a supply line 43 through which electricity is supplied from the battery 37 to the driving circuit 15*c*, a changeover switch 45 that connects the battery 37 to either the driving circuit 15*c* or a charge terminal 44, a current sensor 46 that measures a current charged to and discharged from the battery 37, and a voltage sensor 47 that measures a voltage across terminals of the battery 37 are provided. A charge coupler (not shown) is connected to the charge terminal 44. The charge coupler is used to connect, to the charge terminal 44, a charge circuit etc. through which electricity is charged to the battery 37. The changeover switch 45 switches the destination of connection of the battery 37 to either the driving circuit 15*c* or the charge terminal 44 in accordance with a command from the CPU 15*a*.

When the assist device 10 is being used by the user, the CPU 15*a* switches the destination of connection of the battery 37 to the driving circuit 15*c*. When the battery 37 is to be charged, the CPU 15*a* switches the destination of connection of the battery 37 to the charge terminal 44. The CPU 15*a* switches the destination of connection of the battery 37 according to an operation input by the user. When the charge coupler is connected, the CPU 15*a* determines that the battery 37 is to be charged, and switches the destination of connection of the battery 37 to the charge terminal 44. The current sensor 46 and the voltage sensor 47 are connected to the controller 15. Outputs of the current sensor 46 and the voltage sensor 47 are provided to the controller 15. The calculation part 42*a* and the vibrating motion processing part 42*b* that the controller 15 functionally includes will be described later.

Assist Force Provided by Assist Device 10

Figure 7:
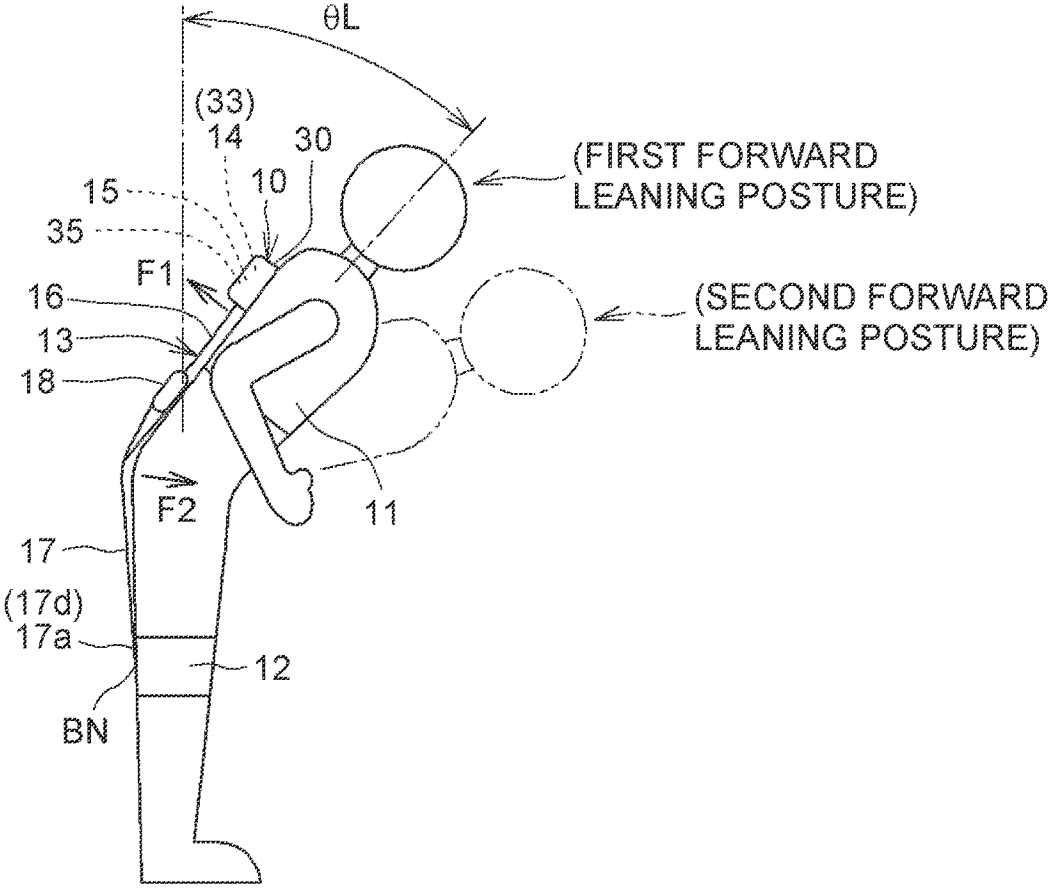
FIG. 7 is a view illustrating a case where the user wearing the assist device changes his or her posture.
Figure 7:
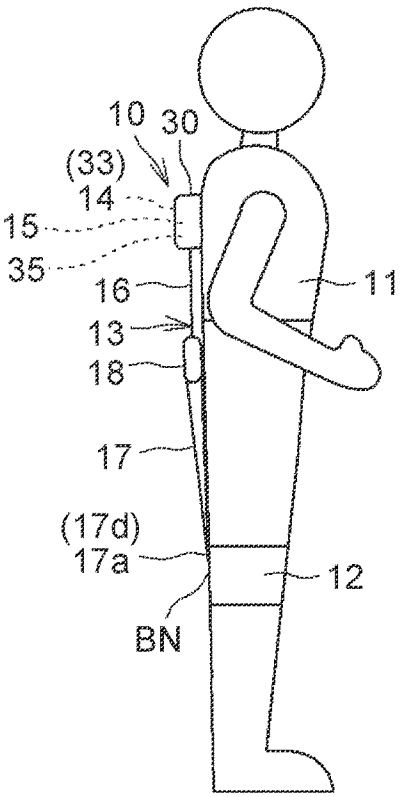

FIG. 7 is a view illustrating a case where the user wearing the assist device 10 changes his or her posture. In response to this change in posture, the assist device 10 can provide an assist force to the user.

When the first belt 16 is reeled onto the driving pulley 35 by the motor 33 of the actuator 14, the coupling member 18 pulls up the second belt 17 toward the actuator 14, i.e., toward an upper side. Both end parts 17*a*, 17*d* of the second belt 17 are attached to the left and right second body-worn units 12. The second body-worn units 12 are fixed on the knees BN. Therefore, when the first belt 16 is reeled onto the driving pulley 35, a tensile force is exerted on the first belt 16 and the second belt 17. This tensile force acts as an assist force for the user.

A case where the user assumes a forward leaning posture from an upright standing posture will be described. When the user starts to change his or her posture to a forward leaning posture, the actuator 14 unreels the belt body 13. Alternatively, the belt body 13 is reeled out without being powered by the actuator 14. Thus, the user can effortlessly assume a forward leaning posture. When the forward leaning angle of the upper body of the user relative to a vertical line reaches θL and the user stops at this forward leaning angle θL, unreeling (reeling out) of the belt body 13 is stopped. Start and stop of a change in posture can be detected by the rotation detector 36 or the sensor 38.

When the user starts to change his or her posture in a direction from a forward leaning posture to an upright standing posture, the actuator 14 reels the belt body 13. Thus, a tensile force is exerted on the belt body 13. Due to this tensile force, an acting force F1 directed rearward is generated in the first body-worn unit 11. This means that the acting force F1 in the direction of raising the upper body of the user in the forward leaning posture is generated. At the same time, an acting force F2 that pushes forward the left hip and the right hip of the user is generated in the second belt 17 due to the tensile force. Thus, the user can easily return from a forward leaning posture to an upright standing posture.

Also when the user maintains a forward leaning posture, the assist device 10 of this disclosure allows the user to easily maintain that posture. Specifically, as shown in the right view of FIG. 7, when the user assumes a first forward leaning posture, the operation of the actuator 14 is stopped to prevent unreeling of the belt body 13. Even when the user tries to assume a posture of leaning further forward (second forward leaning posture), the user cannot assume the second forward leaning posture due to the tensile force of the belt body 13 connecting the first body-worn unit 11 and the second body-worn units 12 to each other. In other words, the assist device 10 tries to keep the user in the first forward leaning posture. This makes it easy for the user to maintain the first forward leaning posture. As a result, the physical burden on the user is reduced, for example, when the user maintains the first forward leaning posture for a long time to perform a task.

Vibrating Motion Process

As described above, the controller 15 functionally includes the calculation part 42*a* and the vibrating motion processing part 42*b*. The calculation part 42*a* has a function of calculating a state of charge (SOC) as a remaining charge level (i.e., a remaining charge amount) of the battery 37 based on outputs of the current sensor 46 and the voltage sensor 47. The calculation part 42*a* obtains the SOC by detecting a discharge current discharged from the battery 37 and a charge current charged to the battery 37 from outputs of the current sensor 46 and integrating (accumulating) the charge amount and the discharge amount.

The vibrating motion processing part 42*b* has a function of executing a vibrating motion process according to the SOC of the battery 37 calculated by the calculation part 42*a*. The vibrating motion process is a process of causing the actuator 14 to perform a vibrating motion of vibrating the belt body 13 by intermittently repeating reeling of a minute amount (a small amount) of the belt body 13 when the SOC of the battery 37 has decreased to a predetermined set value. Reeling a minute amount of the belt body 13 means reeling an amount smaller than the amount reeled during normal operation, and this minute amount is, for example, about a few millimeters or a few centimeters.

Figure 8:
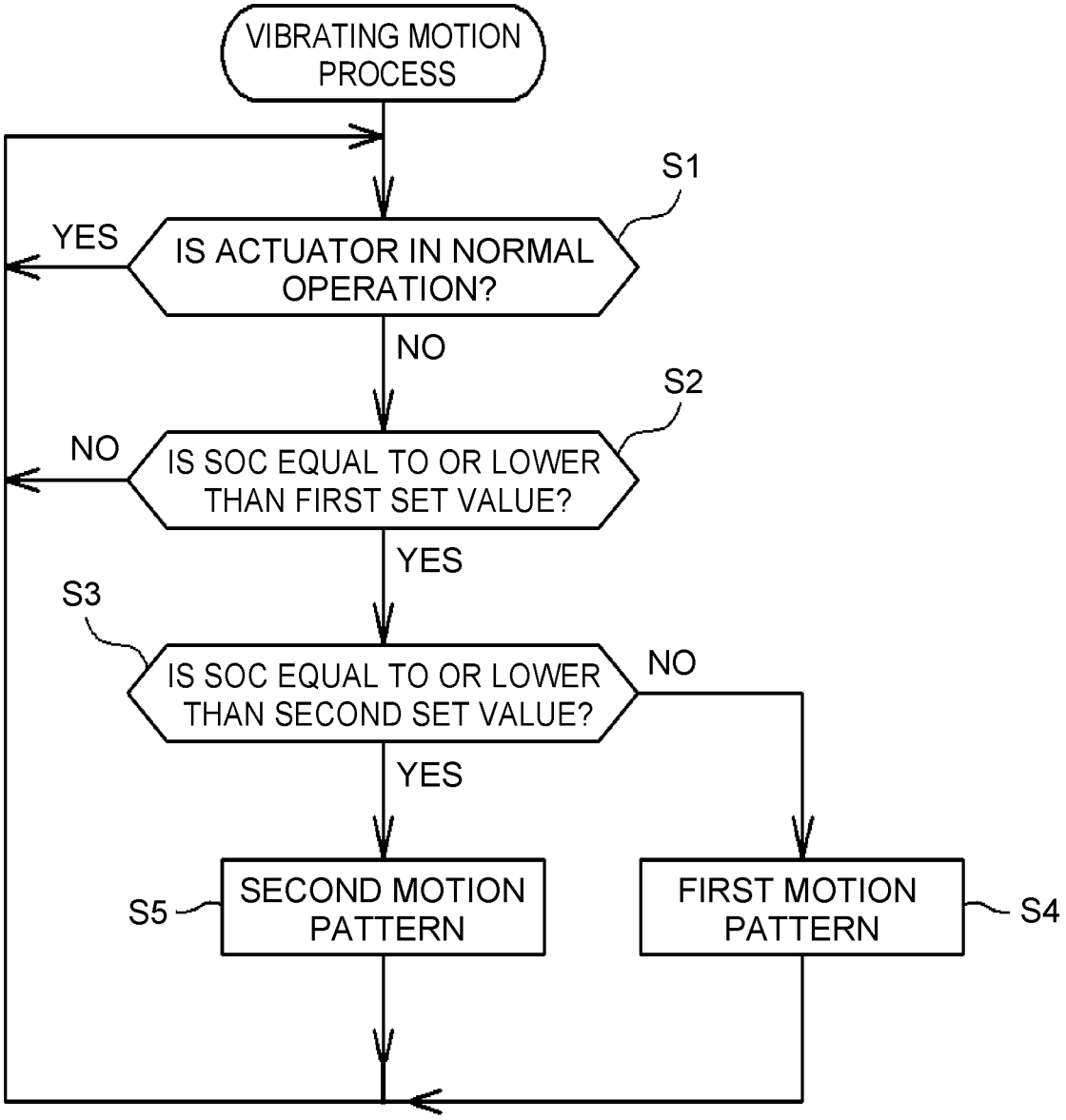
FIG. 8 is a flowchart showing one example of a vibrating motion process.

FIG. 8 is a flowchart showing one example of the vibrating motion process. As shown in FIG. 8, the vibrating motion processing part 42*b* of the controller 15 determines whether the actuator 14 is in normal operation (step S1). The normal operation is an operation in which the actuator 14 rotates the driving pulley 35 according to the posture of the user to reel and unreel the belt body 13. Therefore, the case where the actuator 14 is in normal operation is the case where the actuator 14 is rotating the driving pulley 35 in a certain direction. The case where the actuator 14 is not in normal operation is the case where the posture of the user remains the same and therefore the driving pulley 35 is hardly rotating.

When it is determined that the actuator 14 is in normal operation, the vibrating motion processing part 42*b* repeats step S1. On the other hand, when it is determined that the actuator 14 is not in normal operation, the vibrating motion processing part 42*b* moves to step S2 and determines whether the SOC of the battery 37 is equal to or lower than a first set value (step S2). The first set value is, for example, 50%. When it is determined in step S2 that the SOC of the battery 37 is not equal to or lower than the first set value (that the SOC is higher than the first set value), the vibrating motion processing part 42*b* returns to step S1. When it is determined that the SOC of the battery 37 is equal to or lower than the first set value, the vibrating motion processing part 42*b* moves to step S3 and determines whether the SOC of the battery 37 is equal to or lower than a second set value (step S3). The second set value is a value lower than the first set value, and the second set value is, for example, 20%. When it is determined in step S3 that the SOC of the battery 37 is not equal to or lower than the second set value (that the SOC is higher than the second set value), the vibrating motion processing part 42*b* moves to step S4 and causes the actuator 14 to perform a vibrating motion with a first motion pattern (step S4).

Figure 9A:
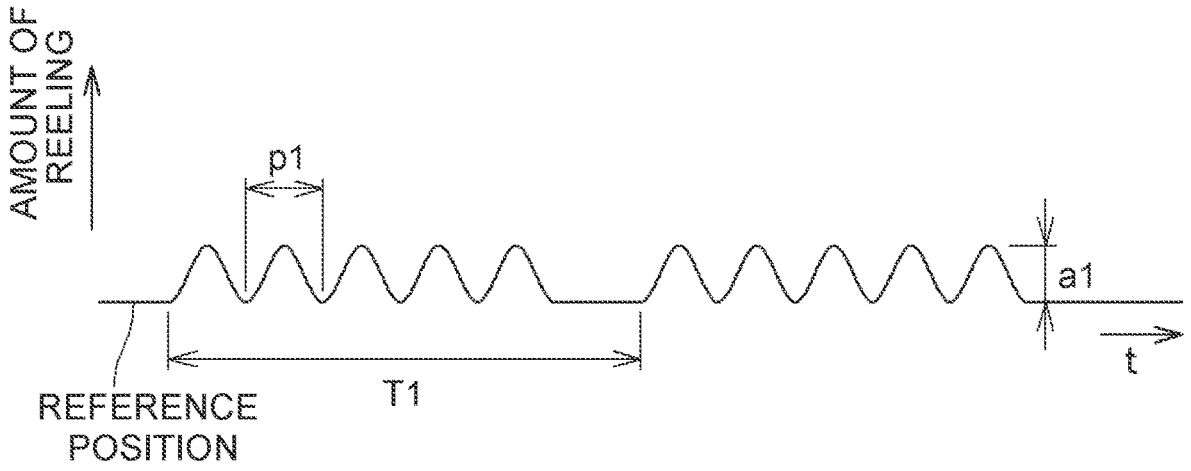
FIG. 9A is graph illustrating a vibrating motion with a first motion pattern.

FIG. 9A is a graph illustrating the vibrating motion with the first motion pattern. In FIG. 9A, the axis of ordinate represents the amount of reeling of the belt body 13. When the actuator 14 performs the vibrating motion, it is not in normal operation and therefore the driving pulley 35 does not rotate so much as required during normal operation. In FIG. 9A, therefore, the position of the belt body 13 based on the current position of the driving pulley 35 that is in an almost stationary state is used as a reference position, and the amount of reeling relative to this reference position is shown. The axis of abscissa represents time.

As shown in FIG. 9A, the vibrating motion with the first motion pattern is a motion of intermittently repeating reeling a predetermined number of times at a fixed repetition period pl. In the first motion pattern, the vibrating motion is repeated in a cycle T1. In the first motion pattern, the amount of reeling of the belt body 13 in the vibrating motion is a1. The vibrating motion processing part 42*b* intermittently and repeatedly performs a reeling action such that the amount of reeling of the belt body 13 becomes a1. The vibrating motion processing part 42*b* controls the actuator 14 such that an amount of the belt body 13 equal to the amount of reeling a1 is unreeled after the reeling action. Thus, an amount of the belt body 13 equal to the amount of reeling a1 is unreeled between consecutive reeling actions. Therefore, the vibrating motion with the first motion pattern is performed with the reference position maintained. The number of times of repetition of reeling included in the vibrating motion is five. These parameters are set to such values that the user can recognize vibration of the belt body 13 caused by the vibrating motion. In step S4, the vibrating motion processing part 42*b* causes the actuator 14 to perform the vibrating motion with the first motion pattern as has been described above.

When the vibrating motion processing part 42*b* moves to step S4, the SOC of the battery 37 is equal to or lower than the first set value and higher than the second set value. That is, the vibrating motion processing part 42*b* causes the actuator 14 to perform the vibrating motion with the first motion pattern (step S4) when the SOC of the battery 37 is equal to or lower than the first set value and higher than the second set value. When it is determined in step S3 that the SOC of the battery 37 is equal to or lower than the second set value, the vibrating motion processing part 42*b* moves to step S5 and causes the actuator 14 to perform a vibrating motion with a second motion pattern (step S5).

Figure 9B:
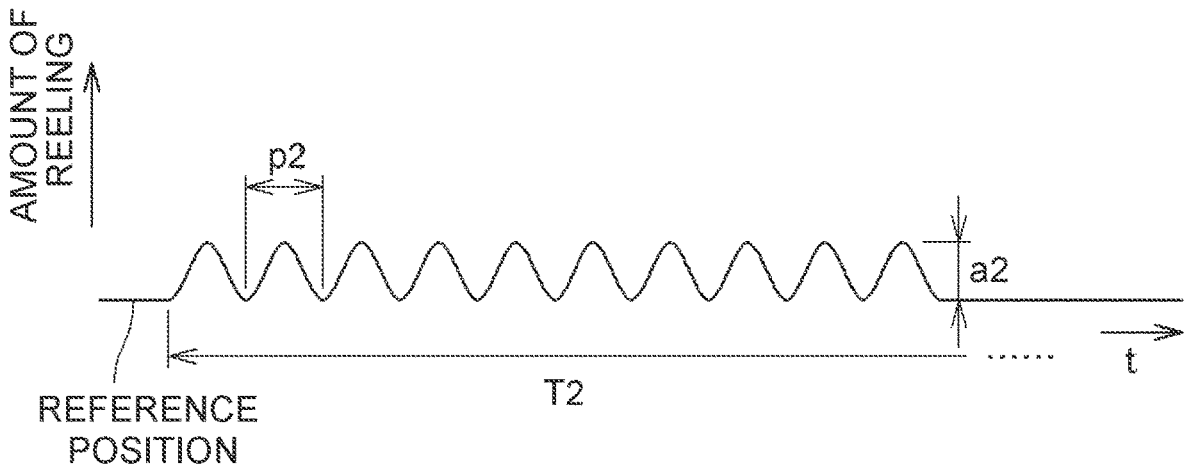
FIG. 9B is a graph illustrating a vibrating motion with a second motion pattern.

FIG. 9B is a graph illustrating the vibrating motion with the second motion pattern. In FIG. 9B, as in FIG. 9A, the axis of ordinate and the axis of abscissa represent the amount of reeling of the belt body 13 and time, respectively.

As shown in FIG. 9B, the vibrating motion with the second motion pattern is a motion of intermittently repeating reeling a predetermined number of times at a fixed repetition period p2. In the second motion pattern, the vibrating motion is repeated in a cycle T2 that is longer than the cycle T1. Also in the second motion pattern, the vibrating motion processing part 42*b* controls the actuator 14 such that an amount of the belt body 13 equal to an amount of reeling a2 is unreeled after the reeling action.

The amount of reeling a2 of the belt body 13 in the second motion pattern is the same as the amount of reeling a1 in the first motion pattern. The repetition period p2 of reeling in the vibrating motion with the second motion pattern is the same as the repetition period p1 of reeling in the vibration motion with the first motion pattern. The number of times of repetition of reeling included in the vibrating motion with the second motion pattern is ten, and is thus set to a value larger than five that is the number of times of repetition of reeling included in the vibrating motion with the first motion pattern. Accordingly, the duration of one vibrating motion with the second motion pattern is longer than the duration of one vibrating motion with first motion pattern. In step S5, the vibrating motion processing part 42*b* causes the actuator 14 to perform the vibrating motion with the second motion pattern as has been described above.

When the vibrating motion processing part 42*b* moves to step S5, the SOC of the battery 37 is equal to or lower than the second set value. That is, the vibrating motion processing part 42*b* causes the actuator 14 to perform the vibrating motion with the second motion pattern when the SOC of the battery 37 is equal to or lower than the second set value (step S5).

As has been described, in this embodiment, the vibrating motion includes a plurality of motion patterns (the first motion pattern and the second motion pattern) different from each other in the number of times of repetition of reeling included in the vibrating motion. The vibrating motion with the first motion pattern is performed when the SOC has become equal to or lower than the first set value, and the vibrating motion with the second motion pattern is performed when the SOC has become equal to or lower than the second set value. Thus, the motion patterns are respectively linked to the set values different from each other. When the vibrating motion is repeated the preset number of times in each of step S4 and step S5, the vibrating motion processing part 42*b* returns to step S1 and repeats the process.

The assist device 10 having the above configuration executes the vibrating motion process of causing the actuator 14 to perform the vibrating motion of intermittently repeating reeling of a minute amount of the belt body 13 when the SOC indicating the remaining charge level of the battery has decreased to the first set value that is a predetermined set value. This vibrating motion can notify the user that the SOC of the battery 37 has decreased to the first set value. Thus, it is possible to appropriately notify the user of the remaining charge level of the battery 37 at a low cost without providing an indicator or the like.

In this embodiment, the first motion pattern is linked to the first set value and the second motion pattern is linked to the second set value. When the SOC of the battery 37 has decreased to the first set value, the vibrating motion processing part 42*b* causes the actuator 14 to perform the vibrating motion with the first motion pattern linked to the first set value, and when the SOC of the battery 37 has decreased to the second set value, the vibrating motion processing part 42*b* causes the actuator 14 to perform the vibrating motion with the second motion pattern linked to the second set value. Thus, the SOC of the battery 37 can be notified stepwise. Therefore, the user can more specifically recognize the SOC of the battery 37.

In this embodiment, the actuator 14 is caused to perform the vibrating motion when it is not in normal operation. Thus, the vibrating motion can be performed while the user remains in the same posture, and thus, the user can easily recognize the vibrating motion compared with when the vibrating motion is performed while the user is changing his or her posture.

The embodiment described above is in every respect illustrative and not restrictive. For example, in the above embodiment, the case where the SOC is used as the remaining charge level of the battery 37 has been illustrated. However, a remaining charge level of the battery 37 that is obtained by integrating current values detected by the current sensor 46 may be used. In the above embodiment, the case where two set values for the SOC are provided has been illustrated. However, only either the first set value or the second set value may be provided, or three or more set values for the SOC may be provided.

In the above embodiment, the case has been illustrated where the first motion pattern and the second motion pattern are the same in terms of the amount of reeling in the vibrating motion and the repetition period of reeling and different from each other in terms of the number of times of repetition of reeling included in the vibrating motion. However, the first motion pattern and the second motion pattern should be different from each other at least in one of these parameters. Further, the cycles of the vibrating motion with the two motion patterns may be set to different cycles. In the case where a larger number of set values for the SOC are provided, varying these parameters enables settings in which each set value is linked to a unique motion pattern.

Figure 10:
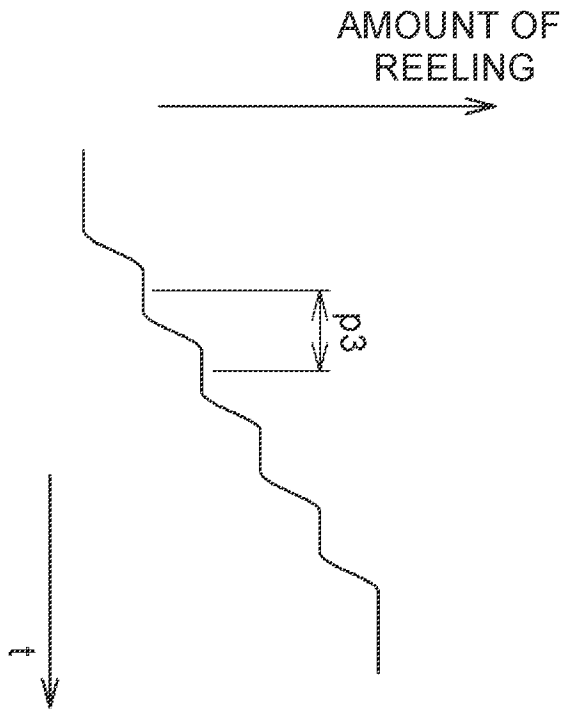
FIG. 10 is a graph illustrating a variation of a vibrating motion.

In the above embodiment, the case has been illustrated where the actuator 14 is configured such that an amount of the belt body 13 equal to the amount of reeling is unreeled after the reeling action in the vibrating motion. However, the position of the belt body 13 may be maintained without the belt body 13 being unreeled after the reeling action. For example, in the vibrating motion shown in FIG. 10, reeling is intermittently repeated at a repetition period p3. Since the belt body 13 is not unreeled after each reeling action, reeling actions are repeated at the period p3 while the belt body 13 maintains its position between the reeling actions. Thus, in the vibrating motion in this case, the amount of reeling of the belt body 13 gradually increases. Also in this case, the belt body 13 can be vibrated and the SOC of the battery 37 can be notified to the user by the vibrating motion.

The scope of the right for the disclosure is not limited to the above embodiments but includes all changes within the scope equivalent to the configuration described in the claims.

What is claimed is:

1. An assist device comprising:

a first body-worn unit that is worn on at least either shoulders or a chest of a user;

a second body-worn unit that is worn on either each of right and left legs or a waist of the user;

a belt body that is provided to extend along a back side of the user, from the first body-worn unit to the second body-worn unit;

an actuator that is provided in either the first body-worn unit or the second body-worn unit and allows a part of the belt body to be reeled and unreeled;

a battery configured to supply electricity to the actuator; and a controller configured to control the actuator, wherein the controller is configured such that when a remaining charge level of the battery has decreased to a predetermined set value, the controller executes a vibrating motion process of causing the actuator to perform a vibrating motion of intermittently repeating reeling of a minute amount of the belt body.

2. The assist device according to claim 1, wherein:

the vibrating motion includes a plurality of motion patterns different from each other in at least one of an amount of reeling of the belt body, a repetition period of reeling, and the number of times of repetition of reeling;

the predetermined set value includes a plurality of predetermined set values different from each other;

the motion patterns are respectively linked to the predetermined set values; and the controller is configured such that in the vibrating motion process, when the remaining charge level of the battery has decreased to one of the predetermined set values, the controller causes the actuator to perform the vibrating motion with one of the motion patterns, the one of the motion patterns being linked to the one of the predetermined set values.

3. The assist device according to claim 1, wherein the controller is configured to execute the vibrating motion process during a time period other than during normal operation in which the actuator is caused to reel and unreel the part of the belt body according to a posture of the user.

* * * * *